United States Patent [19]

Hirokawa et al.

[11] 3,980,385

[45] Sept. 14, 1976

[54] ELECTRICAL CONNECTOR

[75] Inventors: Kazuaki Hirokawa, Tokyo; Tsugio Anbo, Tokorozawa, both of Japan

[73] Assignee: Shinagawa Automotive Electric Wire Co., Ltd., Tokyo, Japan

[22] Filed: Sept. 25, 1974

[21] Appl. No.: 509,235

[30] Foreign Application Priority Data

Oct. 1, 1973 Japan ..... 48-113203[U]
Mar. 1, 1974 Japan ..... 49-23812[U]

[52] U.S. Cl. ..... 339/217 S
[51] Int. Cl.[2] ..... H01R 9/08
[58] Field of Search ..... 339/217 R, 217 S, 176 M, 339/47 R

[56] References Cited

UNITED STATES PATENTS

| | | | |
|---|---|---|---|
| 3,146,051 | 8/1964 | Woofter et al. | 339/47 R |
| 3,277,425 | 10/1966 | Marshall et al. | 339/217 S |
| 3,368,185 | 2/1968 | Dell et al. | 339/217 S |
| 3,425,029 | 1/1969 | Zak | 339/217 S |
| 3,562,698 | 2/1971 | Merry | 339/217 S |
| 3,648,213 | 3/1972 | Kobler | 339/217 S |

*Primary Examiner*—Joseph H. McGlynn
*Assistant Examiner*—Craig R. Feinberg
*Attorney, Agent, or Firm*—W. G. Fasse; W. W. Roberts

[57] ABSTRACT

An electrical connector comprising a wire connected terminal comprising a mating portion matable with a mating portion of another terminal of paired connectors, a wire connecting portion for connecting an electrical wire, a tongue forming portion having a pair of tongues provided at directly opposite side walls thereof extending backward and outward, and four projections provided therein in the vicinity of the rear end of the tongues spaced apart from each other in the peripheral direction such that the tongues are aligned with spacings between the projections, said wire connected terminal being housed in a terminal housing in such a manner that the tongue forming portion of the terminal is supported by top surfaces of four elongated ribs formed inside of a circle sectional aperture of the housing extending in an axial direction spaced apart and in parallel such that the four projections of the terminal may be aligned with said four elongated ribs and abut against the rear ends of the elongated ribs whereby transversal and forward movement of the terminal is prevented, while the rear ends of the tongues abut against the front shoulders of a square sectional aperture formed rearwardly adjacent to the circle sectional aperture as a result of widening of the tongues through outward urging thereof whereby backward movement of the terminal is prevented.

21 Claims, 12 Drawing Figures

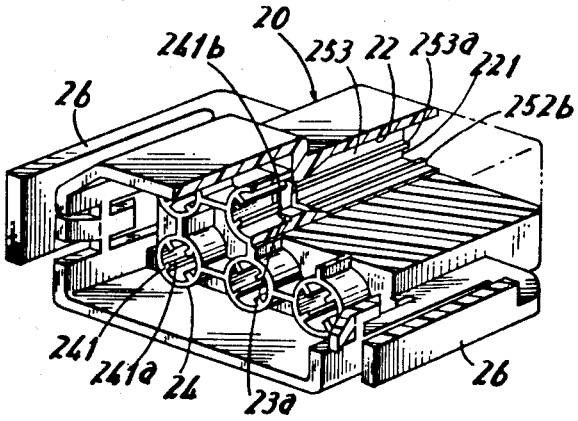
FIG. 4
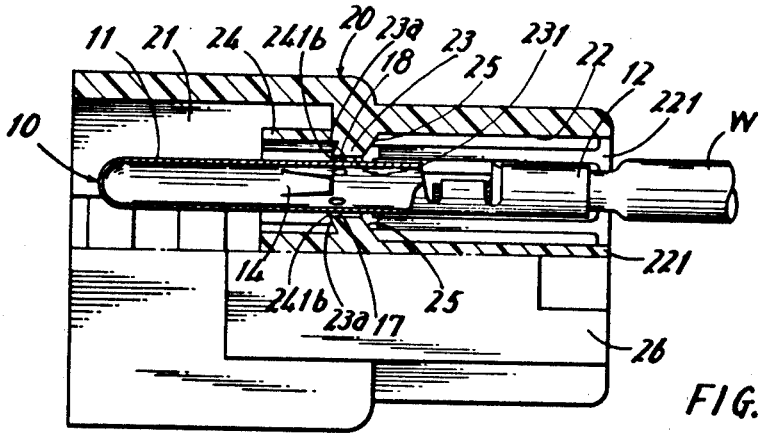
FIG. 5
FIG. 6
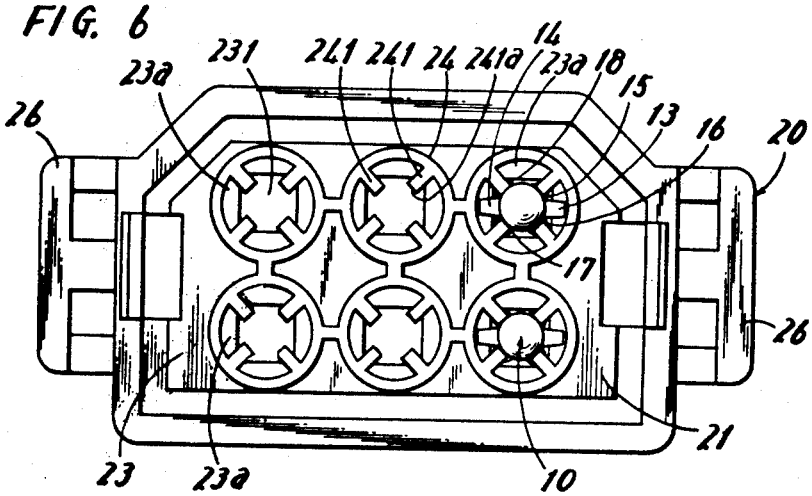

ELECTRICAL CONNECTOR

BACKGROUND OF THE INVENTION

1. Field of the Invention

The present invention relates to an electrical connector and more particularly, to an electrical connector comprising a wire connected terminal housed within a terminal housing.

2. Description of the Prior Art

An electrical connector comprising a wire connected terminal housed within a terminal housing is widely used for connection in appliances such as vehicles, electronic computers, automatic vending machines, etc. As well known, mutual insertion in a mating fashion of paired electrical connectors, each comprising a connecting terminal housed in a housing, accomplishes mutual connection of the terminals. In such connectors, it is strictly required for the terminal to be retained securely in a given position of the housing. Otherwise, the connector may not function properly, because the connectors may not be mated with each other, and thus connection of the terminals may be incomplete. Also, the connector must not allow the terminals to be disengaged from a given position of the housing while paired electrical connectors are engaged with and disengaged from each other repeatedly.

A typical prior art connector of interest is shown in section in FIG. 1. The connector of FIG. 1 comprises a terminal 1 retained within a housing 2. The terminal 1 is provided with a mating portion 1*a* at its front end matable with a terminal of an opposite connector (not shown), a wire connecting portion 1*b* at its rear end, and a portion 1*c* between these portion 1*a* and 1*b* closely fitted by a wall of an aperture of the housing 2, such that the terminal 1 may be prevented or restrained from movement in a direction orthogonal to an axial direction of the terminal 1. On the other hand, the forward movement (in a left direction in FIG. 1) of the terminal 1 along its axial direction is prevented or restrained by a projection 1*d* provided behind the portion 1*c*, while the rearward movement (in a right direction in FIG. 1) of the terminal 1 along its axial direction is prevented or restrained by two tongues 1*e* and 1*e'* disposed forwardly of the portion 1*c* and extending rearwardly and outwardly. Thus, it is understood that a tongue forming portion 1*f* is provided between the mating portion 1*a* and the portion 1*c*. The terminal 1 is normally made from a thin metal sheet through stamping and bending processes. In engaging the terminal 1 into the housing 2, the terminal 1 is inserted from the rear of the housing 2, namely, the right side in FIG. 1. The projection 1*d* on the terminal 1 contacts the rear shoulder portion of an aperture 2*a* holding the portion 1*c* of the terminal 1 in the housing 2, and simultaneously the rear ends of the tongues 1*e* and 1*e'* open outwardly so that the terminal 1 is fixedly secured in the housing 2 in such a manner that the aperture 2*a* holds the portion 1*c*, and the tongue rear end and the projection 1*d* are engaged with the front edge and the rear edge of the aperture 2*a*, respectively. It is to be understood that the connector illustrated is provided with a pin-shaped mating portion 1*a*. An opposite connector with which the connector illustrated mates will be provided with a receptacle-shaped mating portion which is to receive the pin-shaped mating portion 1*a*.

Such a connector as described hereinabove has the following disadvantages. A first problem is that the full length of the terminal 1 becomes larger undesirably by the length corresponding to the tongue forming portion 1*f*, since the tongues 1*e* and 1*e'* have been disposed between the mating portion 1*a* and the portion 1*c*. Another problem is that the distance from the front end of the portion 1*c* to the front end of the mating portion 1*a* becomes longer, so that the holding of the terminal 1 becomes uncertain and the mating portion 1*a* of the terminal 1 may swing, thus resulting in uncertain mating of paired connector. Still another problem is that the distance from the wire connecting portion 1*b* to the mating problem 1*a* becomes longer, which requires that a full length of the housing be longer, and besides the terminal 1 is made of a thin sheet, so that an electrical resistance thereof becomes higher, which is not desirable from a viewpoint of electrical characteristic.

SUMMARY OF THE INVENTION

According to one aspect of the present invention, holding of the terminal and the engagement thereof are adapted to be effected in the same place, namely, the tongue forming portion and the portion being supported by the housing are disposed in the same position rather than being disposed in different positions in the prior art, in terms of the axial direction of the terminal. Accordingly, the full length of the terminal can be shortened. Since the distance from the front end of the portion being supported to the front end of the mating portion becomes shorter, the above mentioned swing of the terminal is prevented and mutual mating of the paired connectors is ensured. Again, since the distance from the wire connecting portion to the mating portion is shorter, the electric resistance of the terminal can be reduced.

According to another aspect of the present invention, the electrical connector comprises a connecting terminal having a plurality of projections, and a terminal housing comprising a terminal inserting aperture, such as a square sectional aperture having corner portions with which the projections engage, respectively. Therefore, the terminal can be held without any rotation around a central axis thereof. Preferably, a compartment for accommodating the terminal wire connecting portion in the housing is provided with guide grooves to guide the tongues when the terminal is inserted into the housing. Accordingly, only by engaging of the terminal into a compartment and insertion of the tongues into the guide grooves, the projections and the tongues can be guided securely into given engaging places. Thus, assembly process of the inventive connector is simplified.

BRIEF DESCRIPTION OF THE DRAWINGS

FIG. 4 illustrates a perspective view, partially in section, of the housing shown in FIG. 3, FIG. 5 illustrates a side view, partially in section, of the inventive electrical connector implemented by combination of the FIG. 2 terminal and the FIG. 3 housing, FIG. 6 illustrates a front view of the FIG. 5 connector.

In the drawings the same reference characters designate the same or like portions.

DESCRIPTION OF THE PREFERRED EMBODIMENTS

Figure 1:
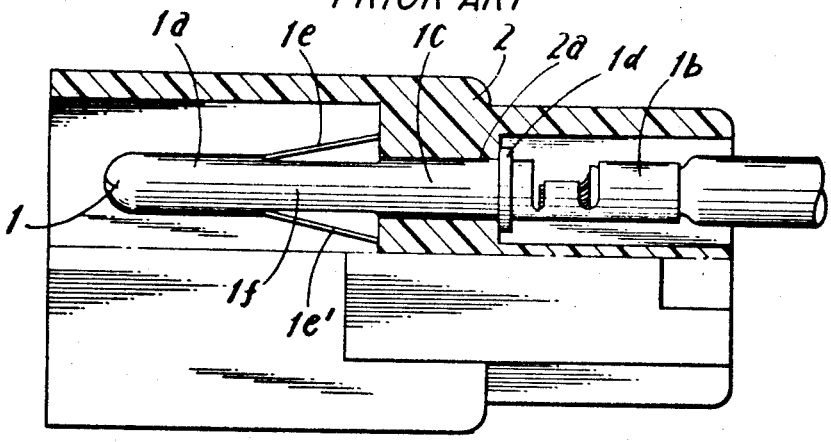
FIG. 1 PRIOR ART
FIG. 1 illustrates a side view, partially in section, of a typical prior art electrical connector.
Figure 2:
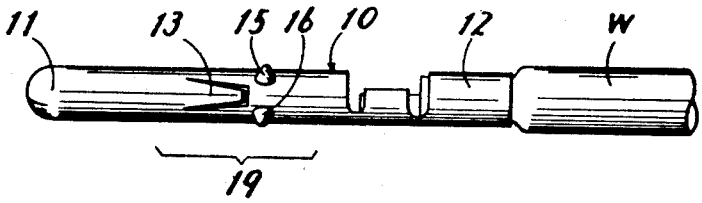
FIG. 2 illustrates a side view of a male type wire connected terminal for use in an embodiment of the present invention.

FIG. 2 is a side view of a male type wire connected terminal for use in an embodiment of the present invention. Referring to FIG. 2, a so-called pin type of male type terminal 10 is shown, which is, for example, made from a thin metallic plate through stamping and bending processes. The terminal 10 comprises a mating portion 11 at its front end, a wire connection portion 12 for connection of the wire W at its rear end, a tongue forming portion 19 in an approximately central portion between these portions 11 and 12, two tongues 13 and 14 at directly opposite sides extending in an outwardly opening form from the front end to the rear end in the tongue forming portion 19, and four projections 15, 16, 17 and 18 mounted slightly behind the tongues 13 and 14. The four projections 15, 16, 17 and 18 are equally spaced apart and projected within a plane orthogonal to the axis of the terminal 10. The two tongues 13 and 14 are formed at directly opposite sides of the tongue forming portion 19 symmetrically with respect to the axis of the terminal 10 and are arranged so that an extending direction of the tongue 13 may be aligned with a spacing formed between the projections 15 and 16 and an extending direction of the tongue 14 may be aligned with a spacing formed between the projections 17 and 18.

Figure 3:
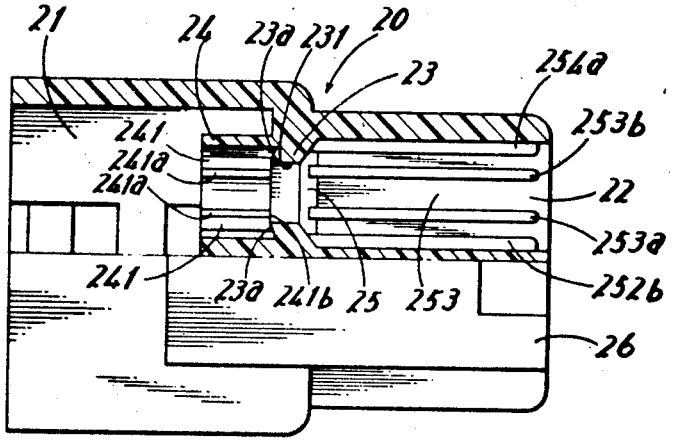
FIG. 3 illustrates a side view, partially in section, of a terminal housing of female type for housing the terminal shown in FIG. 2.
Figure 7:
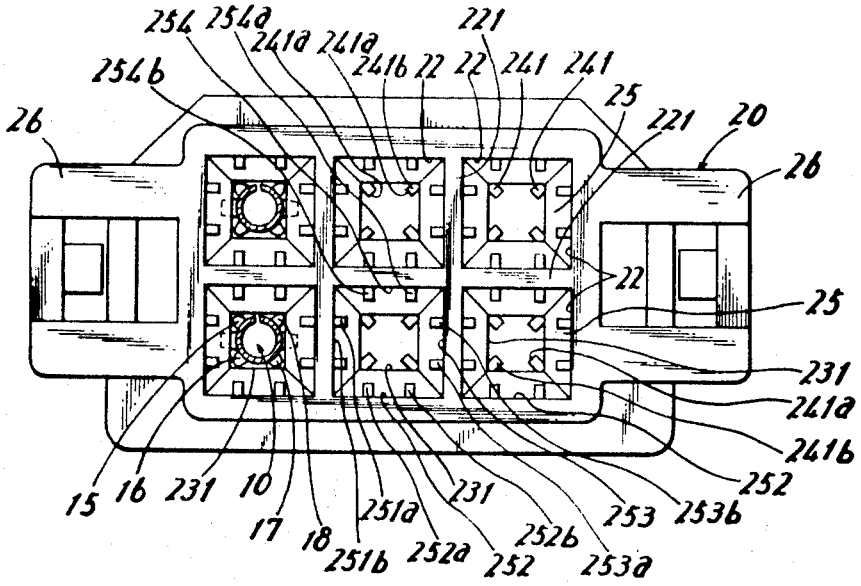
FIG. 7 illustrates a rear view of the FIG. 5 connector.
Figure 8:
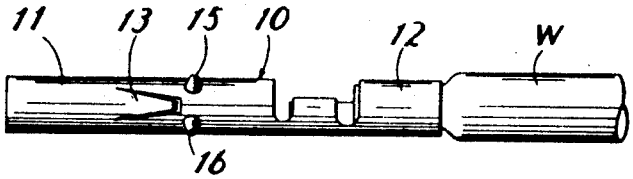
FIG. 8 illustrates a side view of another wired connected terminal which is similar to the FIG. 2 terminal but of female type matable with the FIG. 2 terminal.
Figure 9:
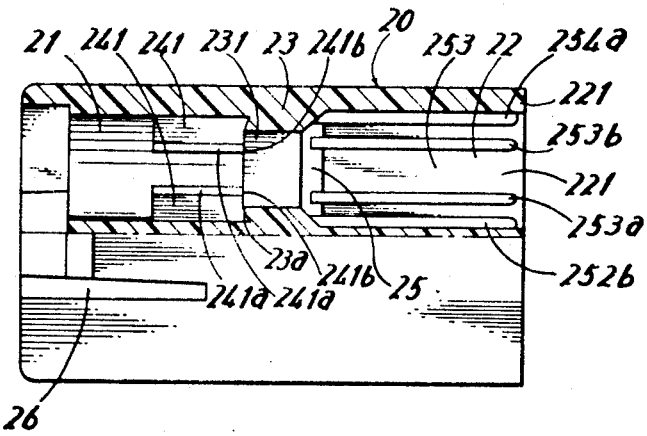
FIG. 9 illustrates a side view, partially in section, of another terminal housing for housing the FIG. 8 terminal, which housing is similar to the FIG. 3 housing but of male type matable with the FIG. 3 housing.
Figure 10:
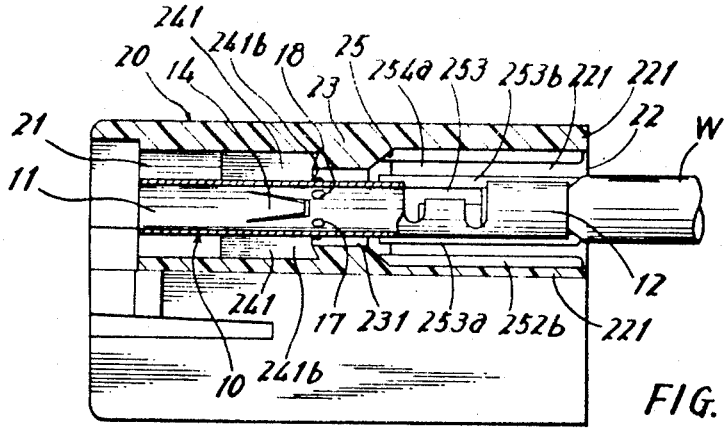
FIG. 10 illustrates a side view, partially in section, of the inventive electrical connector implemented by combination of the FIG. 8 terminal and the FIG. 9 housing which is matable with the FIG. 5 connector.
Figure 11:
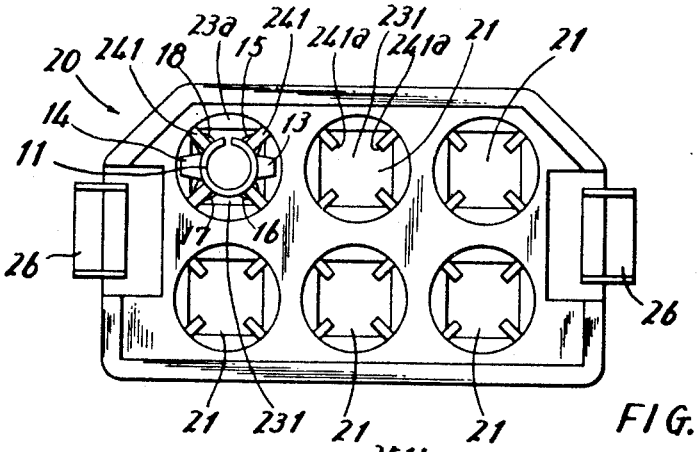
FIG. 11 illustrates a front view of the FIG. 10 connector.
Figure 12:
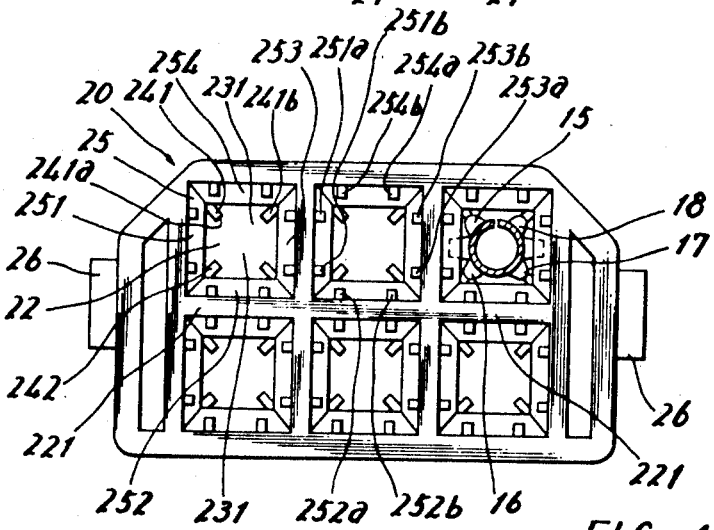
FIG. 12 illustrates a rear view of the FIG. 10 connector.

FIG. 3 is a side view, partially in section, of a terminal housing 20 of female type for housing the terminal shown in FIG. 2. FIG. 4 is a fragmentary perspective view of the housing shown in FIG. 3. FIG. 5 is a side view, partially in section, of the inventive electrical connector implementated by combination of the terminal of FIG. 2 and the housing of FIG. 3. FIG. 6 is a front view of the connector viewed from the left side of FIG. 5. FIG. 7 is a rear view of the connector viewed from the right side of FIG. 5. In FIGS. 6 and 7, the terminals are shown being housed only in a less number of terminal accommodating portions of the housing. Like reference numerals designate corresponding parts throughout the drawings.

Referring particularly to FIG. 3 and FIG. 4, the housing 20 illustrated is of a plastic injection molding, which is adapted to accommodate a plurality of (six terminals in the illustrated example) terminals 10. The housing 20 comprises a compartment 21 for accommodating the opposite terminal mating portion 11 of the terminal 10, a plurality of compartments 22 for accommodating the wire connecting portion 12 of the terminal 10, and a wall 23 partitioning these compartments 21 and 22, the compartment 22 for accommodating the wire connecting portion 12 being partitioned by a partition wall 221 to define the compartment for each terminal 10. Also, apertures 231 through which each terminal 10 extends respectively are formed through the wall 23, the aperture 231 being approximately square-shaped, in section, having four corner portions into which four projections 15, 16, 17 and 18 of the terminal 10 are to be engaged. Hollow cylindrical portions 24 are formed extending forwardly into the compartment 21 from the peripheral edge of the square sectional apertures 231, each of the cylindrical portions 24 having an inner diameter larger than the side of the square sectional aperture 231. Four elongated ribs 241 are formed inside each of the cylindrical portions 24, in alignment with the direction of four corner portions of the square sectional apertures 231. The top surface 241*a* of the elongated ribs 241 are aligned with locations inwardly away from each corner portion of the square sectional aperture 231 as shown in FIG. 4. It is important that the top surfaces 241*a* of four projections 241 are chosen to be adapted to the geometry of the outer surface of the tongue forming portion 19 of the terminal 10. The length of the side of the square sectional aperture 231 is chosen to be slightly larger than the outer diameter of the portion 19 and the four corner portions of the square sectional aperture 231 are chosen to fit the arrangement of projections 15, 16, 17 and 18 of the terminal 10. Each compartment 22 is composed of square sectional apertures larger in the side length than the square sectional apertures 231, and two elongated ribs 251*a*, 251*b*; 252*a*, 252*b*; 253*a*, 253*b*; 254*a*, 254*b* is formed, respectively, in each side wall 221 of each compartment 22, extending from the rear end of the compartment 22 to the front end thereof. Thus, concave grooves 251, 252, 253, 254 for guiding the tongues 13 and 14 of the terminal 10 are formed, respectively, between the ribs 251*a* and 251*b*, 252*a* and 252*b*, 253*a* and 253*b*, 254*a* and 254*b*. The concave grooves 251, 252, 253, 254 are placed in approximately central portion of each partition wall 221 of the compartment, and its groove width (for example, space between the ribs 251*a* and 251*b*) is chosen to be equal to or larger than width of the tongues 13 and 14. Again, referring to FIGS. 3 and 5, an inclined or bevel surface 25 is seen formed between an inner face of the compartment 22 and an inner face of the square sectional aperture 231. Existence of the bevel surface 25 allows the guiding to be performed smoothly when the terminal 10 is inserted into the housing 20 as described later. Preferably, the housing 20 is further provided with an engagement retaining portion 26 which retains mating condition thereof with an opposite connector housing (not shown).

Now, description will be made of how to house the connecting terminal 10 into the terminal housing 20 to assemble the electrical connector of the present invention. First, the mating portion 11 (the front end) of the terminal 10 connected to the wire W at the wire connected portion 12 thereof is inserted into the compartment 22 from the rear side (right side in FIG. 3) of the housing 20 in the condition of FIG. 3. Then, the tongues 13 and 14 of the terminal 10 are inserted into the guide concave grooves 251 and 253 (or 252 and 254), respectively. The mating portion 11 of the terminal 10 passes through the square sectional aperture 231. The tongues 13 and 14 pass the bevel surface 25, and are urged inwardly against its repulsing elastic force, and pass through the square sectional aperture 231 in a restrained condition. Projections 15, 16, 17 and 18 are each guided into each of corner portions of the square sectional aperture 231. Upon further insertion of the terminal 10 in a left direction (forward direction), the tongues 13 and 14 which have been restrained by the square sectional aperture 231 by that time open outwardly and their respective rear ends contact the front edge 23*a* of the square sectional aperture 231, just when the projections 15, 16, 17 and 18 contact the rear end 241*b* (right end in FIG. 3), of the elongated ribs 241. In this condition, the terminal 10 is held by the cylindrical portion 24, such that the outer peripheral face of the portion 19 having the tongues 13 and 14 is supported firmly by each top surface 241*a* of the elongated ribs 241. Two tongues 13 and 14 of the terminal 10 are located between the elongated ribs 241 respectively. Accordingly, as described already, the position, shape and size of the tongues 13, 14 and the four projections 15, 16, 17 and 18 of the terminal 10 should be determined to meet the conditions given hereinabove.

According to the electrical connector described hereinabove, the transversal or lateral movement of the terminal 10 with respect to its central axis is prevented through supporting of the tongue forming portion 19 by four elongated ribs 241. In spite of this fact, the tongues 13 and 14 are formed within the portion 19, and thus the terminal 10 is prevented from being moved rearwardly (right direction in FIG. 5) along its central axis by engagement of the tongues 13 and 14 with the front edge 23*a* of the square sectional aperture 231. The terminal 10 is also prevented from moving forwardly (left direction in FIG. 5) along its central axis through contact of four projections 15 to 18 with the rear end of each elongated rib 241. The terminal 10 is further prevented from rotating around its central axis by engagement of the four projections 15 to 18 with four corner portions of the square sectional aperture 231.

An opposite connector to be mated is also made in the similar manner as described hereinabove. However, a receptacle type of female terminal which is mated with the abovementioned pin type of male terminal is accommodated in the housing in this case. An example of an electrical connector which is composed of such a receptacle type terminal and a housing for accommodating it is shown in FIGS. 8 to 12. The connector comprising male type terminal shown in FIG. 2 to 7 and connector comprising the female type terminal shown in FIG. 8 to FIG. 12 are substantially the same in construction in the major portions except that the mating portion of the former terminal is selected in the form of pin, while the mating portion of the latter terminal is selected in the form of receptacle, and accordingly the mating portion of the housing of the former connector is selected in the form of female, while the mating portion of the latter housing is selected in the form of male. Another major difference is that in the housing of the former connector the cylindrical portions 24 are formed slightly extending forwardly into the compartment 21 from the peripheral edge of the square sectional aperture 231, so that a common space is formed at the front substantial region of the compartment 21, whereas in the housing of the latter connector circle sectional apertures corresponding to the cylindrical portions 24 are formed extending forwardly up to the vicinity of the front end thereof, whereby no such common space is formed, the elongated ribs 241 of the latter housing being formed only in the rear half region of the apertures 24. Illustrations of the latter connector in FIGS. 8, 9, 10, 11 and 12 correspond to the illustrations of the former connector of FIGS. 2, 3, 5, 6 and 7, respectively. Therefore, the same or similar parts are designated by the same reference characters. It is not believed necessary that the latter connector shown in FIGS. 8 to 12 will be described more fully.

The present invention can be embodied in modified versions as described hereinafter without being restricted to the embodiment described above. In order to prevent the terminal 10 from being moved in a forward direction along its central axis, four projections 15 to 18 are engaged with the rear ends 241*b* of the projection 241. However, it is possible to provide an engaging shoulder portion which is separate from the rear end 241*b* of the projections. Furthermore, for example, a terminal which is hermaphroditic or is identical both in male or female, can be used, also, besides the pin or receptacle type, as the connecting terminal 10.

Although this invention has been described and illustrated in detail, it is to be clearly understood that the same is by way of illustration and example only and is not to be taken by way of limitation, the spirit and scope of this invention being limited only by the terms of the appended claims.

What is claimed is:

1. An electrical connector comprising: an elongated electrical terminal and a housing for containing and supporting said terminal in said housing, said terminal comprising a mating portion matable with a mating portion of an opposite terminal of paired electrical connectors, a wire connecting portion for connecting an electrical wire, and an intermediate portion of a predetermined length in the axial direction of said terminal formed contiguous to and between said mating portion and said wire connecting portion, said intermediate portion having a first portion and a second portion, said first portion having a tongue provided at the side wall thereof extending rearward and outward within said predetermined length in the axial direction, and said housing for housing said terminal comprising a first aperture for insertion of said first portion of said terminal, said first aperture having a plurality of elongated ribs formed on the inside wall thereof extending commensurate with the length of said first portion in parallel in the axial direction of said terminal for supporting said first portion of said terminal, the top surfaces of said ribs being in contact with and supporting said first portion, said tongue being positioned between said elongated ribs, and a shoulder against which a rear end of said tongue abuts for preventing rearward movement of said terminal, said electrical connector further comprising means for preventing forward movement of said terminal.

2. An electrical connector in accordance with claim 1, in which said mating portion of said terminal comprises a pin plug.

3. An electrical connector in accordance with claim 1, in which said mating portion of said terminal comprises a receptacle.

4. An electrical connector in accordance with claim 1, in which said mating portion of said terminal is hermaphroditic.

5. An electrical connector in accordance with claim 1, in which said means for preventing forward movement of said terminal comprises a projection provided on said second portion of said terminal.

6. An electrical connector in accordance with claim 5, in which said projection of said terminal engages a rear end of one of said elongated ribs.

7. An electrical connector in accordance with claim 6, in which said housing comprises a second aperture having a corner formed extending in an axial direction rearward of said first aperture for receiving said projection of said terminal, whereby rotational movement of said terminal is prevented.

8. An electrical connector in accordance with claim 7, in which said housing comprises a compartment formed rearward of said second aperture, said compartment comprising a groove for guiding said tongue of said terminal for insertion of said terminal in said housing.

9. An electrical connector in accordance with claim 6, in which said housing comprises a square sectional aperture formed rearward of said first aperture of said projection of said terminal is fitted into one of the corners of said square sectional aperture.

10. An electrical connector in accordance with claim 9, in which said shoulder of said housing is formed at the front end of said square sectional aperture.

11. An electrical connector in accordance with claim 9, in which said terminal comprises three additional projections formed so as to be received by the three other corners of said square sectional aperture.

12. An electrical connector in accordance with claim 11, in which said terminal comprises a second tongue, said first mentioned and second tongues being formed on opposite side walls in alignment with spacings between said projections.

13. An electrical connector comprising an elongated electrical terminal and a housing for containing and supporting said terminal in said housing, said terminal comprising a mating portion matable with a mating portion of an opposite terminal of paired electrical connectors, a wire connecting portion for connecting an electrical wire, a first intermediate portion of a predetermined length in the axial direction of said terminal and being in contact with and supported by said housing formed contiguous to said mating portion, said intermediate portion having a tongue provided at the side wall thereof extending rearward and outward within said predetermined length in the axial direction, and a second intermediate portion formed contiguous to and between said first intermediate portion and said wire connecting portion, and a projection provided on said second intermediate portion of said terminal adjacent the rear end of said tongue, said housing for containing said terminal comprising a first aperture for insertion of said first intermediate portion of said terminal, said first aperture having a plurality of elongated ribs formed on the inside wall thereof extending in parallel in the axial direction of said terminal for supporting said first intermediate portion of said terminal such that said tongue is positioned between said elongated ribs, the rear ends of said ribs being positioned to engage said projection, a shoulder against which a rear end of said tongue abuts for preventing rearward movement of said terminal, and a second aperture having a corner formed extending in the axial direction rearward of said first aperture for receiving said projection of said terminal, whereby rotational movement of said terminal is prevented.

14. An electrical connector in accordance with claim 13, in which said housing comprises a compartment formed rearward of said second aperture, said compartment comprising a groove for guiding said tongue of said terminal during assembly of said terminal in said housing.

15. An electrical connector in accordance with claim 13, in which said second aperture comprises a square sectional aperture formed rearward of said first aperture and said projection of said terminal extends into one of the corners of said square sectional aperture.

16. An electrical connector in accordance with claim 15, in which said shoulder of said housing is formed at the front end of said square sectional aperture.

17. An electrical connector in accordance with claim 15, in which said terminal comprises three additional projections formed so as to be extended into the other three corners of said square sectional aperture.

18. An electrical connector in accordance with claim 17, in which said terminal comprises a second tongue, said first mentioned and second tongues being formed on opposite side walls of said first intermediate portion in alignment with spacings between said projections.

19. A combined housing and an elongated electrical terminal, said terminal comprising a mating portion matable with a mating portion of an opposite terminal of paired electrical connectors, a wire connecting portion for connecting an electrical wire, and an intermediate portion formed contiguous to and between said mating portion and said wire connecting portion, and having a first and second portion, said first portion having a predetermined length in the axial direction of said terminal and having a tongue provided at the side wall thereof extending rearward and outward within said predetermined length in the axial direction, said housing for containing said terminal comprising a first aperture for insertion of said intermediate portion of said terminal, said first aperture having a plurality of elongated ribs formed on the inside wall thereof extending commensurate with said predetermined length of said intermediate portion in parallel in the axial direction of said terminal for contacting and supporting said first portion of said terminal by the top surfaces of said ribs such that said tongue is positioned between said elongated ribs, a shoulder against which a rear end of said tongue abuts for preventing rearward movement of said terminal, and means on said second portion for preventing forward movement of said terminal.

20. A housing in accordance with claim 17, which further comprises a square sectional aperture formed rearward of said aperture and in which said terminal comprises four projections being adapted to the four corners of said square sectional aperture.

21. A combined wire connected terminal and a housing, said housing having an aperture, a plurality of elongated ribs of a predetermined length formed on the inside wall of said aperture in parallel in an axial direction, and an engaging portion formed at the rear end of said aperture, said terminal comprising a mating portion matable with a mating portion of another terminal, a wire connecting portion, an intermediate portion formed contiguous to and between said mating portion and said wire connecting portion and having first and second portions, said first portion being of a length substantially commensurate with said predetermined length of said elongated ribs and being supported by the top surfaces of said elongated ribs of said aperture of said housing and having a tongue extending rearward and outward within said length of said first portion, said tongue being positioned between said adjacent elongated ribs and engaging said engaging portion of said housing, and a projection formed on said second portion adjacent to the rear end of said tongue and for abutting against the rear end of one of said elongated ribs.

* * * * *

UNITED STATES PATENT OFFICE
CERTIFICATE OF CORRECTION

Patent No. 3,980,385 Dated September 14, 1976

Inventor(s) Kazuaki Hirokawa, Tsugio Anbo

It is certified that error appears in the above-identified patent and that said Letters Patent are hereby corrected as shown below:

Column 8, line 51, change "claim 17" to --claim 19--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*